US005112107A

United States Patent [19]

Doughty

[11] Patent Number: 5,112,107

[45] Date of Patent: May 12, 1992

[54] SPRING-ACTION CHAIR

[75] Inventor: Fred C. Doughty, South Pasadena, Calif.

[73] Assignee: Brown Jordan Company, El Monte, Calif.

[21] Appl. No.: 581,467

[22] Filed: Sep. 12, 1990

[51] Int. Cl.[5] ..... A47C 3/00

[52] U.S. Cl. ..... 297/288; 297/287

[58] Field of Search ..... 297/288, 286, 287, 294, 297/307, 420, 290, 289, 297, 299, 258, 281, 18

[56] References Cited

U.S. PATENT DOCUMENTS

| | | | |
|---|---|---|---|
| 2,401,542 | 6/1946 | Booth | 297/287 X |
| 2,855,978 | 10/1958 | Hamilton | 297/288 X |
| 4,787,672 | 11/1988 | Werner | 297/287 X |
| 4,911,500 | 3/1990 | Saiger | 297/287 |

FOREIGN PATENT DOCUMENTS

| | | | |
|---|---|---|---|
| 946197 | 5/1949 | France | 297/287 |
| 436031 | 9/1945 | Italy | 297/288 |
| 372513 | 5/1932 | United Kingdom | 297/288 |

*Primary Examiner*—Laurie K. Cranmer
*Attorney, Agent, or Firm*—Christie, Parker & Hale

[57] ABSTRACT

A spring-action chair comprising a seat frame having left and right sides and left and right spring-action support means rigidly secured to the left and right sides of the seat frame for elevating the seat frame above the ground. Each support means comprises an elongated, continuous support member of composite configuration having sections which include a first section extending upwardly and rearwardly from a first ground engaging end along a first angle, the member then having a first reversed bend in an elevated horizontal intermediate section extending forwardly therefrom, adjacent the seat frame to a second reversed bend, with the member then having a second angular section extending downwardly and rearwardly at a second angle and terminating at a second ground engaging end. The first ground engaging end is spaced transversely from the first ground engaging end, with the first and second angular sections bypassing one another with a lateral spacing between them normally being maintained to avoid contact between them, so that the left and right support members when secured to the sides of the seat frame can act in unison as elongated spring members for transmitting a rocking motion to the seat frame when pressure is applied from the seat frame toward the support members.

11 Claims, 3 Drawing Sheets

14
21
22
56
60
64
52
62
18
20
70
72
42
12
23
36
40
40
32
44
44
43

15
12
78
76
32
42
43
18
16
74
70
72
76
52
62
14
78
64
64

SPRING-ACTION CHAIR

FIELD OF THE INVENTION

This invention relates generally to outdoor patio furniture and, more particularly, to a spring-action chair, comprising left and right side seat frames elevated from the ground and supported by left and right side continuous support members of composite configuration.

BACKGROUND OF THE INVENTION

Outdoor patio furniture has become a highly competitive market. Manufacturers are always looking for ideas that cut down on manufacturing cost and time. The present invention is a chair structure that reduces manufacturing time and costs.

Patio chairs that have a rocking action have been common in the industry. However, the complexity of these designs has increased manufacturing costs and time. The standard patio chair that has rocking capability incorporates a rocking mechanism, usually a spring. The back and seat portions of the chair are constructed with metal composite frame members. The frame members are usually reinforced by horizontal support members. The rocking mechanism is attached to the support members. The rocking mechanism has to be quite heavy to not only support the weight of the user, but also must have the capability to produce the rocking motion. One problem associated with this type of design is that the rocking mechanism can wear out and require replacement.

Underneath the rocking mechanism is the base which not only must be strong enough to support the seat and the rocking mechanism but must also keep the chair from sliding or tipping over when the user is rocking in it. As a result, the base requires a sturdy construction. This leads to a second drawback of this type of rocking chair in that the chair is quite heavy and difficult for children or older adults to move around and could cause injury if a toe or foot gets caught under the base.

Still another drawback of this type of chair is its manufacturing cost because it requires more parts and therefore more materials. It also takes longer to manufacture and assemble, therefore, also adding to the expense.

Thus, there exists a need for a patio chair with rocking capabilities that is lightweight, less expensive, and reduces manufacturing time. The chair should also have an attractive design.

SUMMARY OF THE INVENTION

The present invention provides an improved chair with rocking capabilities which eliminates the problems of the prior existing chairs and is simple and inexpensive to manufacture.

In one embodiment, the chair of the present invention comprises a seat frame having left and right L-shaped sides which form the back and seat surfaces, and left and right spring-action support means secured to the left and right sides of the seat frame for elevating the seat frame above the ground. Each support means comprises an elongated continuous support member of composite configuration having sections which include a first section which extends upwardly and rearwardly at an angle from a first ground engaging end, the member then having a first reversed bend which leads to an elevated horizontal intermediate section extending forwardly therefrom adjacent to the seat frame which acts as an armrest, to a second reverse bend with the member then having a second angular section extending downwardly and rearwardly at a second angle and terminating at a second ground engaging end.

The first and second angular sections bypass one another with a lateral spacing between them normally being maintained to avoid contact between them. This allows the left and right support members, when secured to the sides of the seat frame, to act in unison as an elongated spring member for transmitting a rocking motion to the seat frame when pressure is applied from the seat frame toward the support members.

The long, continuous spring-action support members thus provide side supports for elevating the chair above the ground while also acting as spring-action members transmitting a rocking motion to the seat. The composite configuration of the spring-action support members can be easily produced from conventional metal extrusion bending equipment common in the patio furniture industry. The spring-action members are then simply welded to sides of the seat frame, also by conventional welding equipment used in the industry. The spring-action members are light in weight, and no additional springs or rocker assemblies or base structures are required. As a result, manufacturing costs and assembly time are greatly reduced.

These and other aspects of the invention will be more fully understood by referring to the following detailed description and the accompanying drawings.

DETAILED DESCRIPTION

Figure 1:
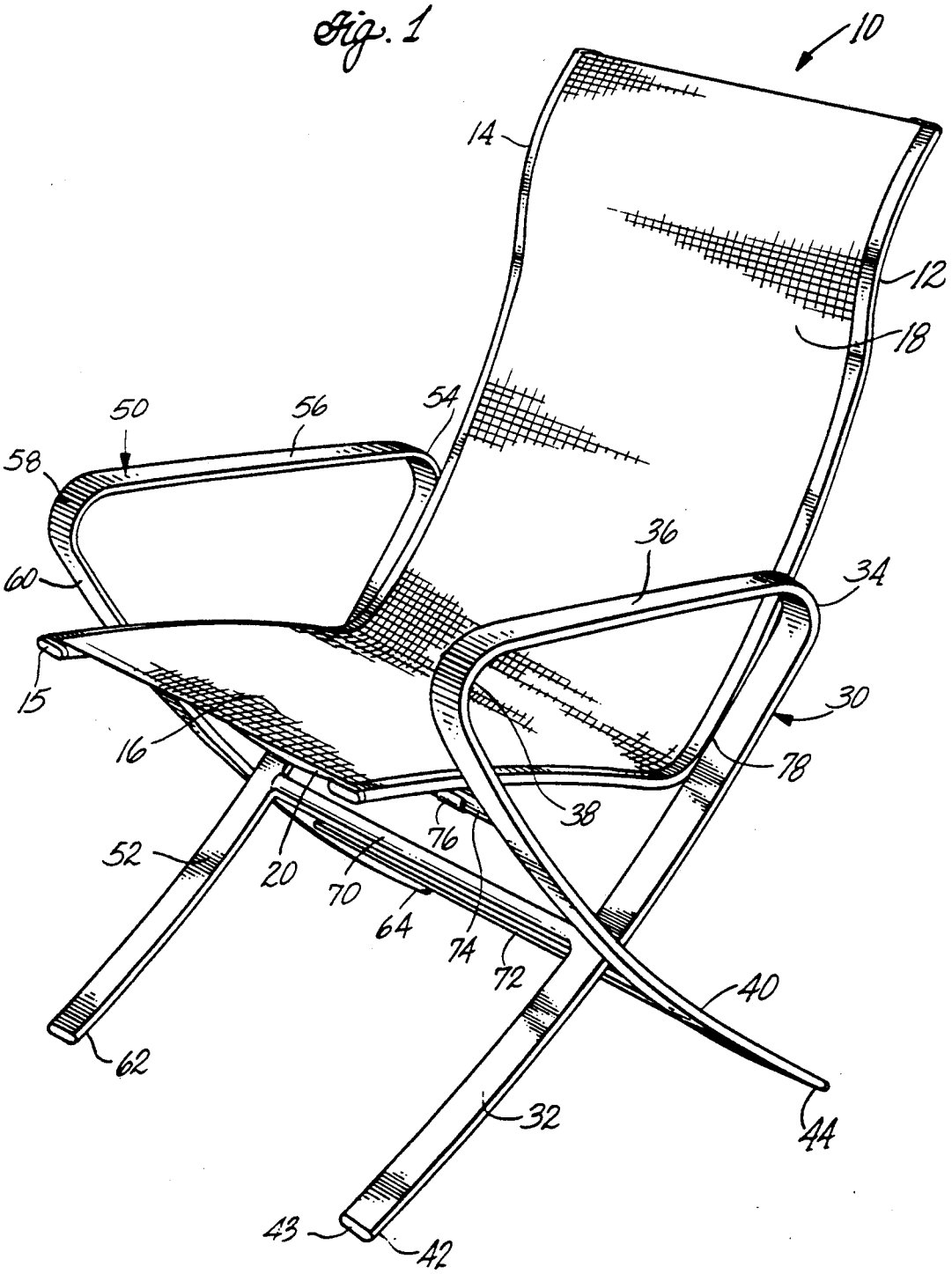
FIG. 1 is a perspective view of the spring-action chair arrangement according to the principles of the invention.
Figure 5:
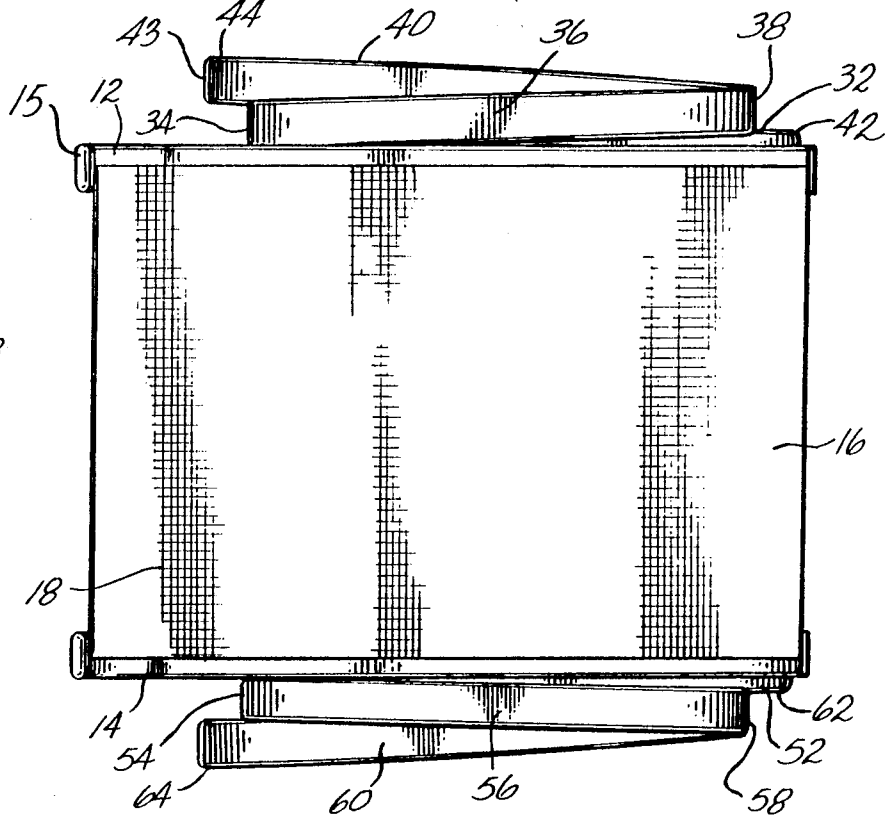
FIG. 5 is a top view of FIG. 1.
Figure 2:
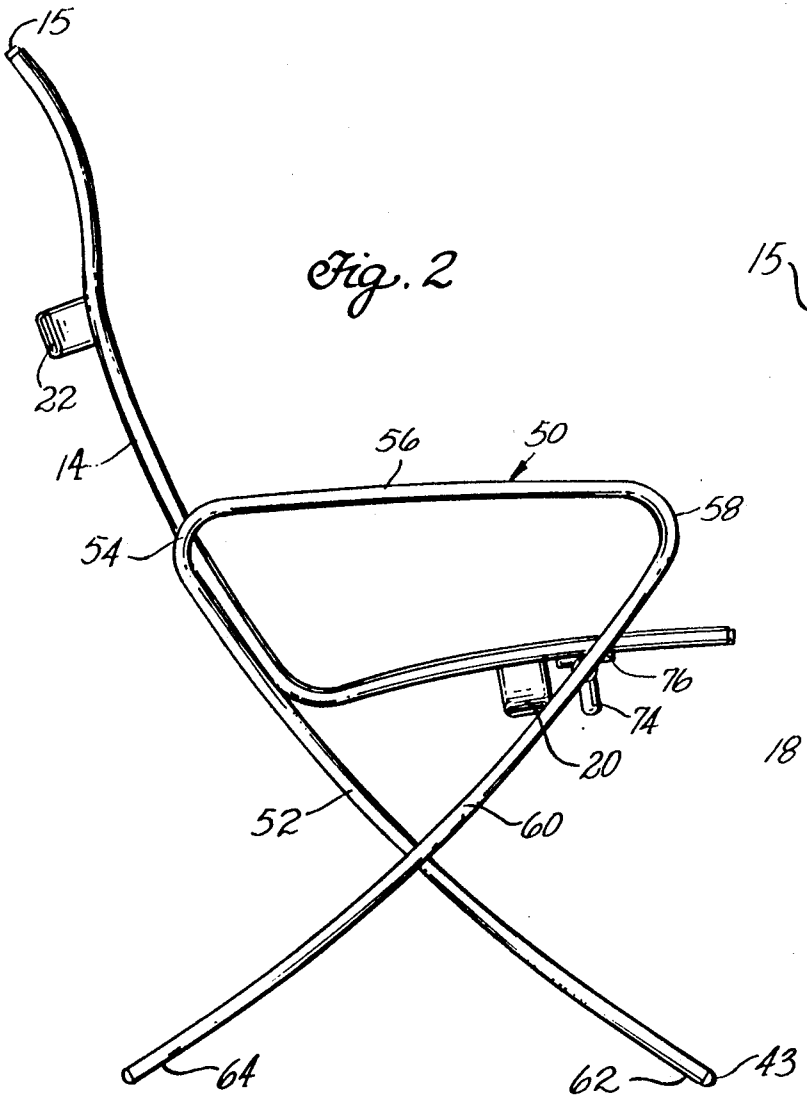
FIG. 2 is a side view of FIG. 1.
Figures 3, 4:
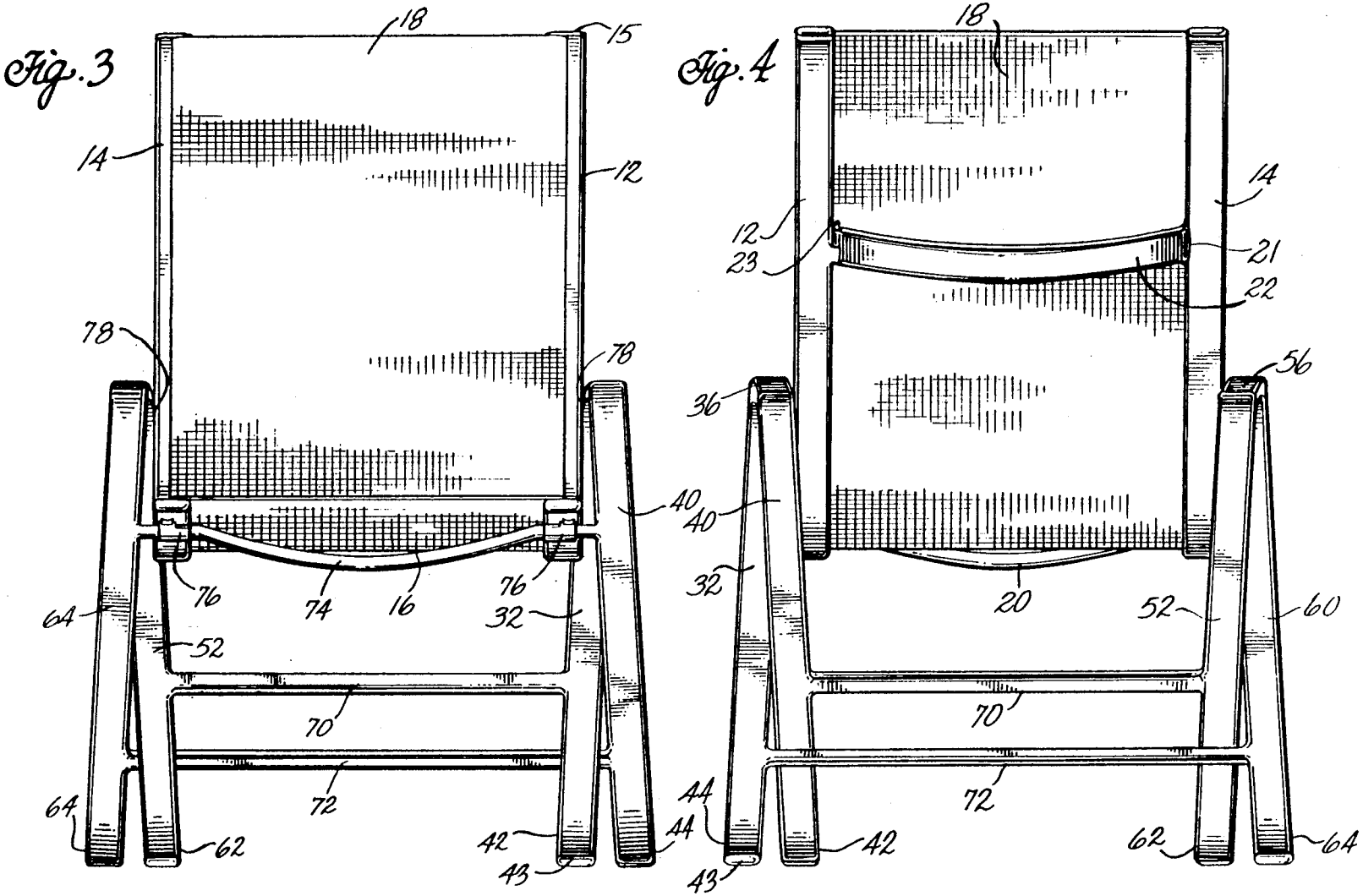
FIG. 3 is a front rear view of FIG. 1.
FIG. 4 is a rear view of FIG. 1.

Referring to the drawings, FIG. 1 illustrates a spring-action chair 10 constructed in accordance with the principles of this invention. The chair 10 comprises a left L-shaped seat frame 12 and a right L-shaped seat frame 14. Stretched between and fastened to the seat frames is a fabric material which forms the seat surface 16 and the back surface 18. The left and right seat frames are an oblong tubular structure with plugs 15 in either end. The right and left seat frames are connected to one another by horizontal frame members 20 and 22 as shown best in FIG. 4. Horizontal frame member 20 is located beneath the seat surface 16 and horizontal frame member 22 is located behind the back surface 18. The horizontal seat members 20 and 22 are connected to the right and left seat frame members by welding 21 or by tapping a hole and threading a pin 23.

Secured to the left and right sides of the seat frame, respectively, are left and right spring-action support means 30 and 50 that elevate and support the seat frame above the ground. Each support means comprises an elongated continuous support member of composite configuration. The support member is preferably made of an aluminum extrusion with three substantially cylindrical internal hollow channels equidistantly spaced apart and running parallel throughout the entire length of the support member. The hollow channels give the support member a lightweight feature along with greater flexibility.

The left support member has a continuous configuration which is bent into sections which include a first angular section 32 extending upwardly and rearwardly from a first ground engaging end 42 to a first reverse bend 34 which leads to a horizontal intermediate section 36 which extends forwardly from the first reverse bend adjacent the seat frame and acts as a left armrest. A second reverse bend 38 extends from the front end of the horizontal intermediate section and leads to a second angular section 40 which extends downwardly and rearwardly at a second angle, terminating at a second ground engaging end 44.

The right spring-action support member 50 has an identical composite configuration having sections which include an angular first section 52 extending upwardly and rearwardly from a first ground engaging end 62 along a first angle to a first reversed bend 54, which leads to a right horizontal intermediate section 56 extending forwardly from the first reversed bend 62 adjacent to the seat frame to act as a right armrest. The right horizontal intermediate section leads to a second reverse bend 58 which continues into a second angular section 60 extending downwardly and rearwardly at a second angle, terminating at a second ground engaging end 64.

The first and second ground engaging ends of both support members 30 and 50 have a wear-resistant pad 43. These pads are generally made of plastic and provide an excellent gripping surface with the ground. As can be seen best in FIGS. 3 and 4 in each of the right and left spring-action support members, the first ground engaging end is laterally spaced from the second ground engaging end. This allows for the first and second angular sections to bypass one another with a lateral spacing between them normally maintained to avoid contact between them, so that the left and right spring-action support members, when secured to the sides of the seat frame, can act in unison as elongated spring members for transmitting a rocking motion to the seat frame when pressure is applied from the seat frame toward the left and right support members.

The lateral spacings between the first and second angular sections of each support member are maintained by a first section spreader 70 and a second section spreader 72, both of which are rigid longitudinally. The spreaders 70 and 72 are both preferably made of aluminum extrusions containing the parallel internal hollow channels described above. The first section spreader 70 is welded to and connects the right first section 32 with the left first section 52. The second section spreader 72 is welded to and connects the right second section 40 with the left second section 60. The lateral spacing is achieved by the second section spreader 72 being longer than the first section spreader 70. The left and right spring-action support members thus bypass each other on each side of the seat frame, below the seat frame, without contacting one another.

The front portion of the seat frame is supported by, and attached to, the right and left spring-action support members by a horizontal seat frame support member 74. The seat frame support member 74 is welded to the second sections 40 and 60 of the spring-action support members. The horizontal seat frame support member 74 runs underneath the seat section of the seat frame. An attachment means 76 is located at either end of the horizontal seat frame support member underneath the seat frame member.

The back section of the seat frame is connected to the spring-action support means, specifically at the first sections 32 and 52 by separate welds 78.

The rocking motion of the chair is accomplished because of the configuration of the spring-action support members. When a backward force is applied to the back section of the seat, the forces are transmitted to the right and left spring-action support members. The first sections 32 and 52 go backward in the same direction as the force that is applied to the back section of the seat. These forces are transferred through the first sections 32 and 52 through the reverse bends to the second sections 40 and 60. The right and left second sections exert a restoring force to then return the seat in a forward direction. The forward rocking motion creates a force that is transmitted through the second sections 40 and 60 through the support members via the reverse bends to the first sections 32 and 52 which exert a resistive force in opposition to the forward rocking force. The rocking forces continue in this fashion. The right and left first sections and the right an left second sections of the spring-action support members are able to direct their forces independently because of the lateral gap between them which allows the forces to be directed back and forth through the continuous support members. Also, the fore and aft ground engaging ends of each support members are not tied together and each is able to move (by lifting slightly) relative to the other, through the spring-action of the member when rocking forces are applied to it from the seat frame.

Because there is no separate rocking mechanism, the chair incorporates less parts and is therefore much easier to manufacture. The composite configuration of the support members creates a chair that is very lightweight and easily movable. Because of these features, there is less material needed to manufacture the chair and, therefore, it is less expensive to manufacture.

Although the present invention has been described and is illustrated with respect to a preferred embodiment thereof, it is to be understood that it is not to be so limited, since changes and modifications may be made therein which are within the full intended scope of this invention as hereinafter claimed.

What is claimed is:

1. A spring-action chair comprising a seat frame having left and right sides, and left and right spring-action support means secured to the left and right sides of the seat frame for elevating the seat frame above the ground, each support means comprising an elongated, continuous one-piece support member of a configuration having sections which include a first angular section terminating at the ground and extending upwardly and rearwardly from a first ground engaging end along a first angle, the support member then having a first reversed bend and an elevated intermediate section extending forwardly therefrom adjacent the seat frame to a second reversed bend, with the support member then having a second angular section extending downwardly and rearwardly at a second angle and terminating at the ground at a second ground engaging end spaced longitudinally from and being unconnected at ground level to the first ground engaging end, the first and second angular sections bypassing one another with a lateral spacing between them normally being maintained to avoid contact between them, so that the left and right spring-action support means, when secured to the sides the seat frame, can act in unison as elongated spring members for transmitting a rocking motion to the seat frame when pressure is applied from the seat frame toward the support members.

2. A spring-action chair of claim 1 in which the intermediate section is a generally horizontally extending armrest.

3. A spring-action chair of claim 1 in which the first angular sections of the left and right spring-action support means are interconnected by a rigid first cross-member, and the second angular sections of the left and right spring-action support means are interconnected by a rigid second cross-member, in which the first and second cross-members are independent of the seat frame, and in which one cross-member is longer than the other cross-member to maintain the spacing where the first and second angular sections bypass one another.

4. A spring-action chair of claim 1 including means rigidly and integrally affixing the left and right sides of the seat frame to the first angular sections of the support members.

5. A spring-action chair of claim 4 in which the left and right sides of the seat frame are rigidly and integrally affixed to the first angular sections by welding.

6. A spring-action chair of claim 4 including a front cross-member between the second angular sections of the support members affixed thereto and extending to the underside of the seat frame and rigidly affixed to the seat frame.

7. A spring-action chair comprising a generally L-shaped seat frame having left and right sides and defining a bottom frame member and a rear portion, and a pair of complementary spring-action seat supports for resting on the ground on left and right sides of the seat frame and holding the seat frame spaced above the ground and for use in transmitting a spring-action rocking motion to the seat frame under weight applied to the supported seat frame, each spring-action seat support comprising an elongated, continuous one-piece support member of a configuration having sections which include a first angular section terminating at the ground and extending upwardly and rearwardly from a first ground engaging end along a first angle, the support member then having a first reversed bend and an elevated intermediate section extending forwardly therefrom adjacent the seat frame to a second reversed bend, with the second member having a second angular section extending downwardly and rearwardly at a second angle and terminating at the ground at a second ground engaging end spaced longitudinally from and being unconnected at ground level to the first ground engaging end, the first and second angular sections bypassing one another with a lateral spacing between them normally being maintained to avoid contact between them, and in which the first angular section of each support member is rigidly secured to a corresponding rear portion of the seat frame so as to be integral therewith, so that weight applied downwardly to a front portion of the seat frame causes leverage to be applied to the seat frame which is absorbed by the second angular section of the support member and then restored in a spring-action in an opposite direction.

8. A spring-action chair of claim 7 in which the left and right sides of the seat frame are rigidly and integrally affixed to the first angular sections of the support members by welding.

9. A spring-action chair of claim 7 in which the first angular sections are rigidly interconnected by a rigid first cross-member and the second angular sections are interconnected by a separate second rigid cross-member, in which the first and second cross-members are independent of the seat frame, and in which one cross-member is longer than the other cross-member to maintain the spacing where the first and second angular sections bypass one another.

10. A spring-action chair of claim 7 including a front cross-member rigidly affixed between the second angular sections of the spring-action seat supports and extending to and rigidly affixed to the underside of the seat bottom frame member.

11. A spring-action chair comprising a generally L-shaped seat frame defining a bottom frame member and a rear portion, the seat frame having left and right sides, and left and right spring-action support means secured to the left and right sides of the seat frame for elevating the seat frame above the ground, each support means comprising an elongated, continuous one-piece support member of a configuration having sections which include a first section terminating at the ground and extending upwardly and rearwardly from a first ground engaging end along a first angle, the support member then having a first reversed bend and an elevated intermediate section extending forwardly therefrom adjacent the seat frame to a second reversed bend, with the member then having a second angular section extending downwardly and rearwardly at a second angle and terminating at the ground at a second ground engaging end spaced longitudinally from and being unconnected at ground level to the first ground engaging end, the first and second angular sections bypassing one another with a lateral spacing between them normally being maintained to avoid contact between them, the left and right spring-action support means being interconnected by a rigid first cross-member interconnecting the first angular sections and a separate second cross-member rigidly interconnecting the second angular sections, the first and second cross-members being independent of the seat frame, in which one cross-member is longer than the other cross-member to maintain the spacing where the first and second angular sections of the support members bypass one another, and in which the first angular section of each support member is rigidly and integrally affixed to the rear portion of the seat frame, and further including means rigidly interconnecting the bottom frame member of the seat frame to the second angular sections of the seat supports on opposite sides of the spring-action chair.

* * * * *